US006462637B1

(12) United States Patent
Laverick

(10) Patent No.: US 6,462,637 B1
(45) Date of Patent: Oct. 8, 2002

(54) ELECTRICAL CONNECTOR

(75) Inventor: Robert Clement Laverick, Vatgley (GB)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/439,659

(22) Filed: Nov. 15, 1999

(51) Int. Cl.[7] ..... H01F 27/04
(52) U.S. Cl. ..... 336/107; 336/192; 439/578
(58) Field of Search ..... 439/578–580; 336/182–192, 107

(56) References Cited

U.S. PATENT DOCUMENTS

| | | | | |
|---|---|---|---|---|
| 2,149,529 A | | 3/1939 | La Fave | |
| 2,416,148 A | | 2/1947 | Borgerd et al. | |
| 2,461,098 A | | 2/1949 | Weatherly | |
| 2,531,638 A | | 11/1950 | Miller | |
| 2,571,769 A | | 10/1951 | Segall | |
| 2,575,140 A | | 11/1951 | Smith | |
| 2,632,132 A | | 3/1953 | Delano | |
| 2,823,362 A | | 2/1958 | Geroulo et al. | |
| 3,223,954 A | | 12/1965 | Mateer | |
| 3,980,380 A | | 9/1976 | Cieniawa et al. | |
| 4,229,714 A | | 10/1980 | Yu | |
| 4,316,647 A | * | 2/1982 | Bailey et al. | 439/578 |
| 4,517,540 A | | 5/1985 | McDougal | |
| 4,723,916 A | | 2/1988 | Fusselman et al. | |
| 4,858,076 A | | 8/1989 | Tsai | |
| 4,960,389 A | | 10/1990 | Frantz | |
| 4,969,839 A | | 11/1990 | Nilsson | |
| 4,972,575 A | | 11/1990 | Frantz et al. | |
| 5,066,249 A | * | 11/1991 | Doye et al. | 439/585 |
| 5,137,469 A | * | 8/1992 | Carpenter et al. | 439/578 |
| 5,183,412 A | | 2/1993 | Nagafuju | |
| 5,205,761 A | * | 4/1993 | Nilsson | 439/578 |
| 5,346,410 A | | 9/1994 | Moore, Jr. | |
| 5,639,262 A | * | 6/1997 | Lim | 439/607 |

* cited by examiner

*Primary Examiner*—Elvin Enad
*Assistant Examiner*—Tuyen T. Nguyen
(74) *Attorney, Agent, or Firm*—Roger C. Turner

(57) ABSTRACT

An electrical connector includes a connector part (10) with a conductive shell (12) and front and rear contacts (26, 56, 58, 59) at the front and rear of the shell, wherein a transformer (40) with first and second windings lies within the shell and is connected to the front and rear contacts to provide impedance transformation and DC isolation. An entire connector assembly (100) includes a termination assembly (101) lying rearward of the connector part, the termination assembly including a cable clamp (102) for holding a cable (104), the rear of the termination assembly having slots for holding cable wires (110, 112, 113) after they have been bent at least about 90°. The rear contacts of the connector part are in the form of insulation displacement contacts which cut into the wires as the connector part is moved rearwardly against the front of the termination assembly, to thereby connect the front contacts of the connector part to the cable wires. A holder (120) fits around the rear termination assembly and around a rear section (124) of the connector shell to hold them together by latching to the rear section.

13 Claims, 8 Drawing Sheets

ELECTRICAL CONNECTOR

CROSS REFERENCE

This application claims priority from PCT/GB96/00892 filed Apr. 11, 1996 and U.K. patent applications 9507574.3 filed Apr. 12, 1995 and 9508461.2 filed Apr. 26, 1995.

BACKGROUND OF THE INVENTION

This invention relates to electrical connectors, especially those with a coaxial mating end and a cable termination or other second connector end, which provides impedance transformation. The invention is also related to a connector that readily terminates to wires of a cable.

Connectors that have a front end with contacts for mating to another connector and a rear end with mateable contacts or with means for connecting to wires of a cable, sometimes require impedance transformation and/or DC isolation. This is especially so where the mateable contacts at the front end of the connector are coaxial contacts. The rear end may be a coaxial cable, twisted wire pair or other wire line, or a mateable coaxial connector end. It would be desirable to minimize the number of separate components that a technician must handle in making a connection with impedance transformation and/or DC isolation.

There is often a need to connect the front end of a cable to contacts of a connector. A connector of simple construction which enabled simple cable termination, would also be of value.

SUMMARY OF THE INVENTION

In accordance with one embodiment of the present invention, a connector assembly and connector part thereof are provided, that are of simple and compact construction. The connector part provides impedance transformation by a transformer lying directly within a connector housing, between contacts at the front and rear ends of the housing. This enables an impedance transformation without requiring connection to an external transformer. The transformer is preferably of torroidal shape and has its windings connected to traces on a circuit board that lies within the connector, with the plane of the circuit board being normal to the axis of the connector. For a coaxial connector front end, the inner conductor can extend through the hole in the torroidal transformer.

Where the rear of the connector assembly connects to the front end of a cable, the rear of the connector part, which includes the transformer, includes insulation displacement contacts that face rearwardly. A separate termination assembly includes a cable clamp that clamps to the cable and includes a front end with walls formed to hold the front end of cable wires that have been bent at least 90°. The cable wires on the termination assembly are mated to the connector part by moving the connector part rearwardly until slots of the insulation displacement contacts receive the wires. Then, a separate holder is slid forwardly to surround the termination assembly and to receive and snap to a rear section of the connector part shell.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
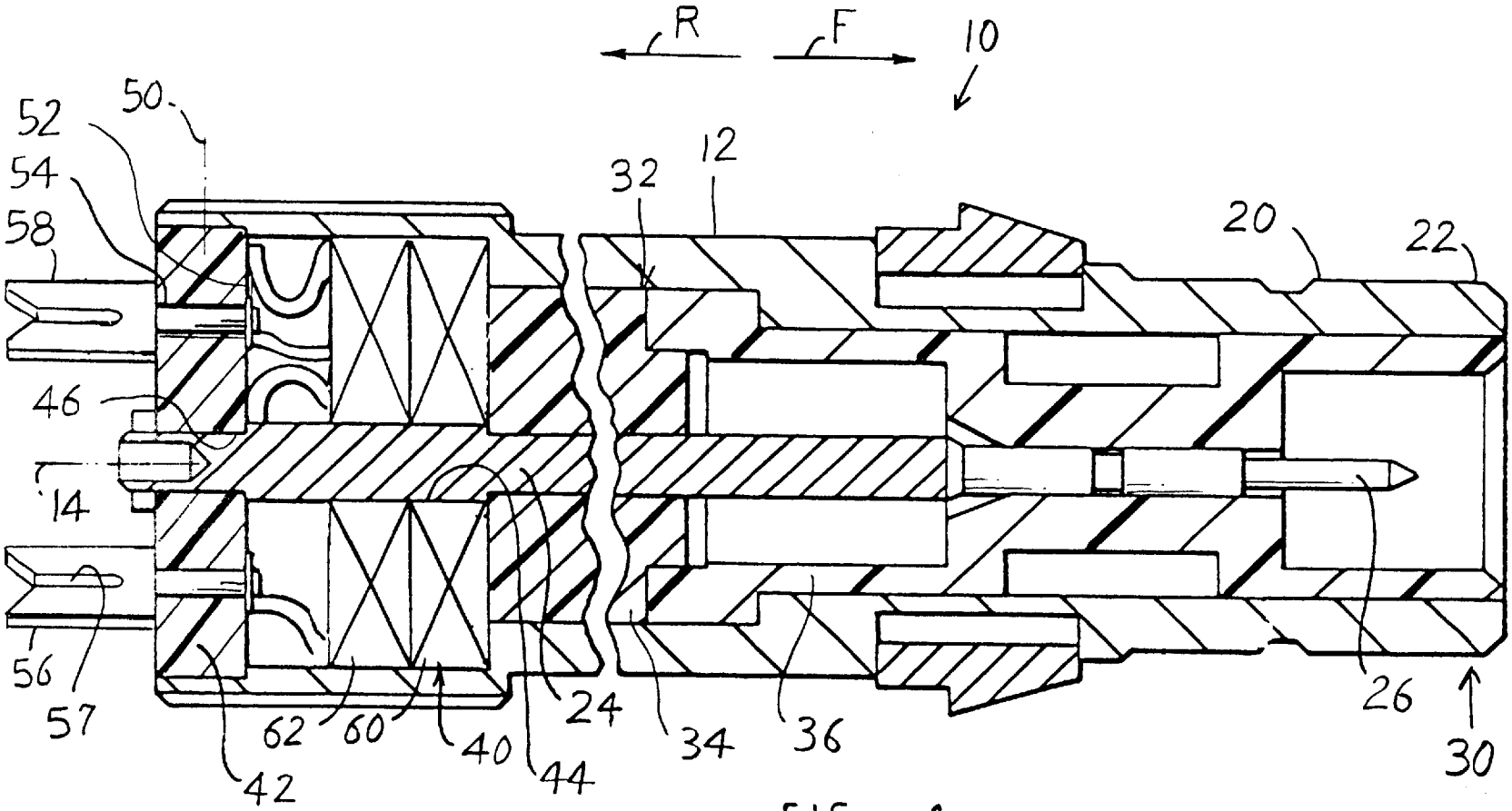
FIG. 1 is an axial sectional view of an electrical connector part constructed in accordance with one embodiment of the present invention.

FIG. 1 illustrates an electrical connector part 10 which includes a housing 12 in the form of an elongated electrically conductive shell that extends along an axis 14 in forward and rearward directions F, R. The forward portion 20 of the shell forms a forward terminal or contact 22 at the front end of the connector part. An inner coaxial conductor 24 has a front end at 26 that forms another front contact of the mateable front connector end 30 which is a coaxial connector end. That is, the front connector end can mate with another connector in a pin-and-socket connection by merely moving them together. An insulator device 32 which includes a pair of insulators 34, 36, holds the inner coaxial conductor 24 so it extends along the axis 14.

The shell 12 has a large area rearward of the insulator, which holds a transformer 40 and a circuit board 42. The transformer 40 is of torroidal shape, with a hole 44 at its center and occupies at least half of the area within the shell at the locations of the transformer windings. The inner coaxial conductor 24 extends through the transformer hole 44, and passes through a hole 46 in the circuit board, where the inner conductor is fixed in position and soldered to a circuit board trace. An inner conductor 24 can be made to form a transformer core that couples the two windings. The circuit board lies in a plane 50 (its opposite faces are parallel to the plane 50) that is normal to the axis 14, with the circuit board lying closely within the shell and preferably in an interference fit therein. The circuit board has conductive traces such as 52, 54 for connecting to the transformer 40 and to rear contacts 56, 58 at the rear of the connector part, as well as to the center conductor 24 and shell 12. As shown in FIG. 1 and as is usual in circuit board construction, traces 52 are thin layers of conductive material bonded to a face of the board.

The transformer 40 has first and second windings 60, 62 that are connected to traces on the circuit board, and that also can be connected directly to the shell outer conductor 12 and the inner coaxial conductor 24.

The transformer provides a change in impedance, and also can provide for DC isolation of the front and rear contacts.

Figure 2:
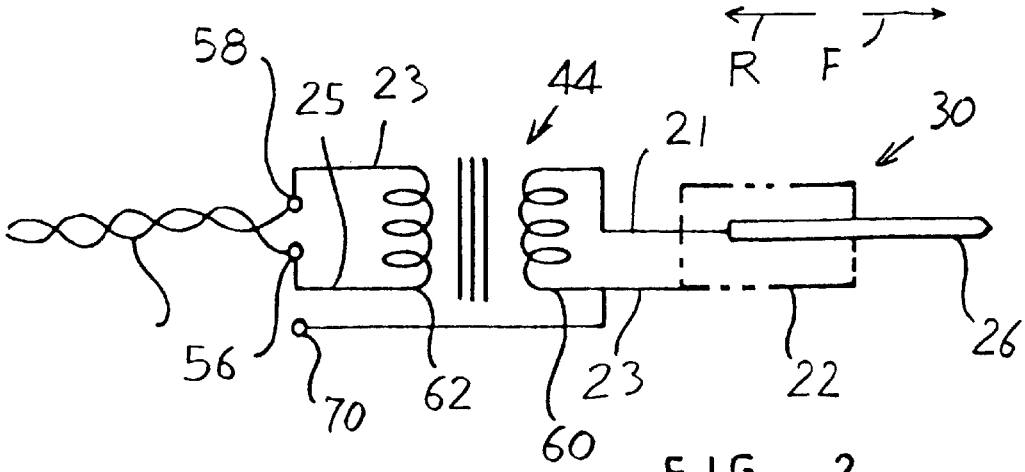
FIG. 2 is a schematic diagram showing the electrical coupling provided by the connector part and connector assembly of FIGS. 1–3, between a coaxial connector end and a balanced or twisted wire pairs.

FIG. 2 is a circuit diagram of the connector part of FIG. 1, wherein the transformer 44 provides DC isolation between the coaxial terminals 22, 26 at the front of the connector part and the two wire terminals 56, 58 at the rear. By appropriate choice of turn ratios of the windings, the transformer provides impedance transformation to permit matching between lines of different impedance, to permit maximum signal power transfer. Such a transformer is sometimes known as a Balun transformer. The drawing of FIG. 2 shows an optional ground terminal 70 which is connected to the shell and which can be used for connection to a screen of a balanced or twisted line pair.

Figure 3:
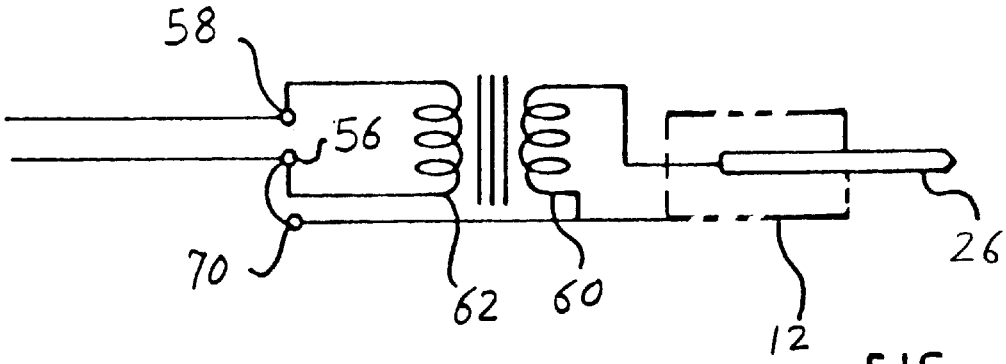
FIG. 3 is a schematic diagram showing another coupling arrangement between a coaxial connector end and a pair of lines where one of the lines is grounded.

FIG. 3 shows a balance pair of lines with one line grounded by connecting one of the terminals 56 to ground at 70 and to the connector shell 12.

Figure 5:
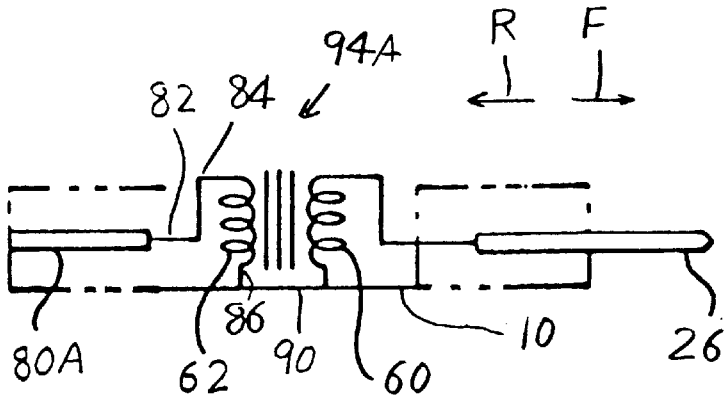
FIG. 5 is a schematic diagram of the connector assembly of FIG. 4.
Figure 4:
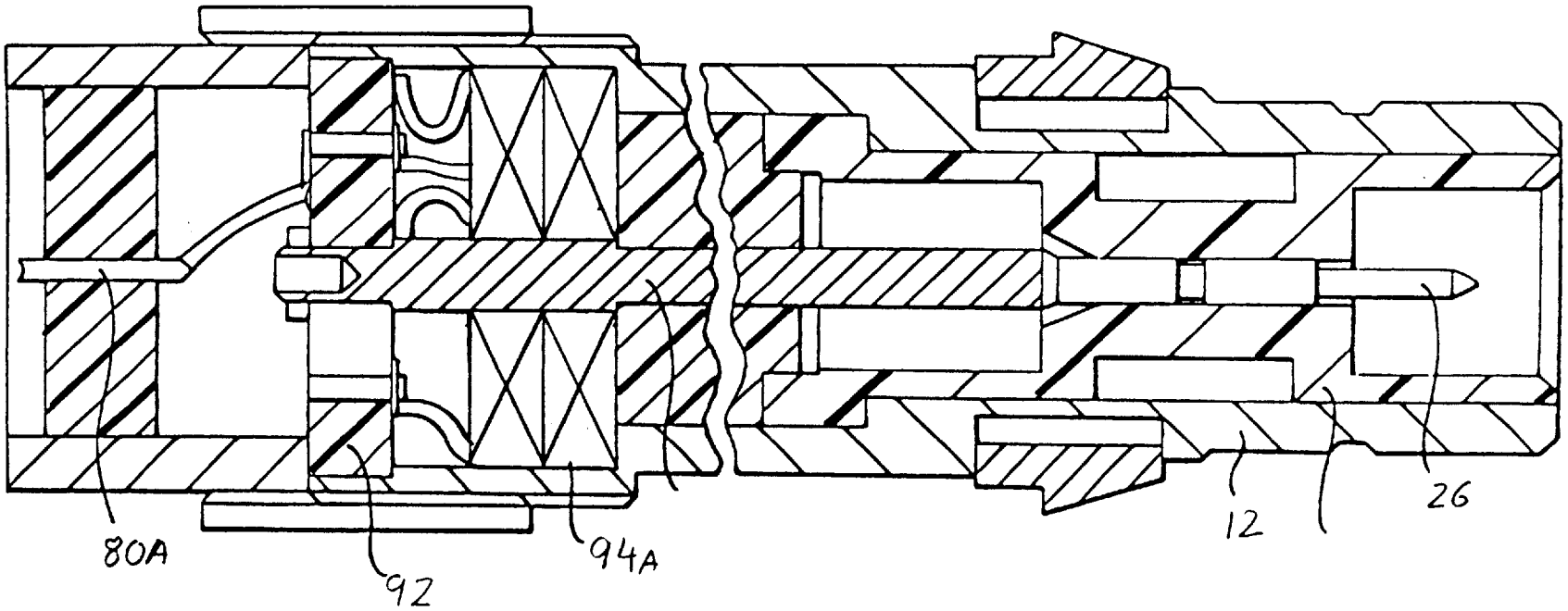
FIG. 4 is a partial axial sectional view of an electrical connector assembly constructed in accordance with another embodiment of the invention, with mateable connector ends at its front and rear.
Figure 14:
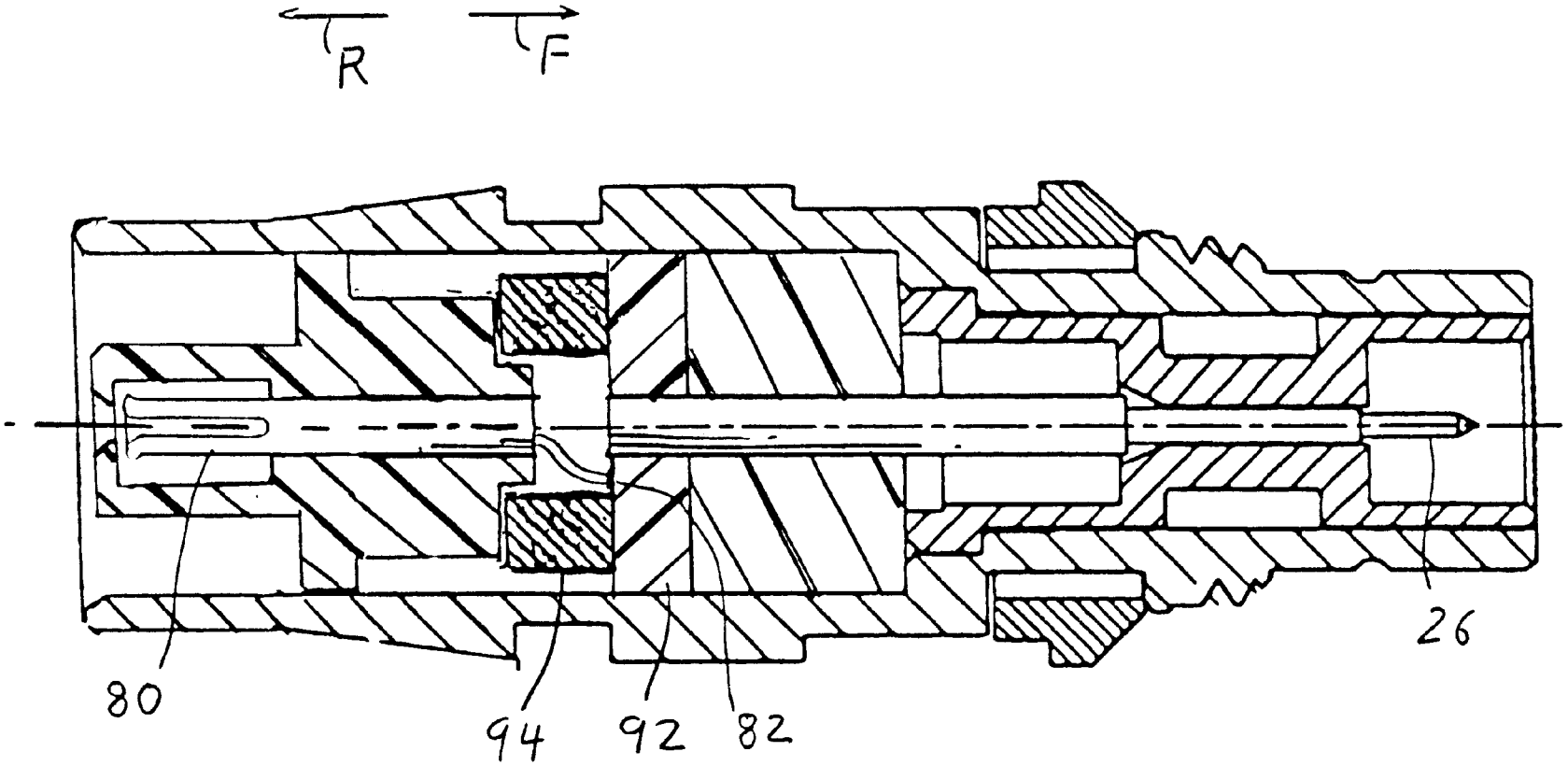
FIG. 14 is a sectional view of a coaxial connector of the type shown in FIG. 4, with a center conductor whose front and rear ends are respectively pin and socket contacts.

The schematic diagram of FIG. 5 shows a coaxial-to-coaxial connector having a front end identical with that of FIG. 1. However, at the rear end, instead of a wire termination, a socket type coaxial connector interface portion is provided. The socket connector interface portion has a central or inner contact 80 which is connected to a trace 82 on the circuit board. The trace 82 extends to the end 84 of the second winding of the transformer 94A. The other end 86 of the second winding is connected to the shell through another trace 90 on the circuit board. Alternatively, a second printed circuit board may be provided for receiving and securing the socket contacts similar to the arrangement of board 42 and inner conductor 24 of FIG. 1. In such an arrangement, wire connections between the two boards would be required. FIG. 5 shows, schematically, the electrical connections of the connector construction of FIG. 4. By appropriate choice of turns ratios, different impedance lines can be coupled and matched, as from 75 ohms to 120 ohms. FIG. 14 shows an example of such a connector, where the socket contact 80 and pin contact 26 are coupled through a circuit board 92 and a transformer 94. It is also possible to provide a plug-to-plug or socket-to-socket type of connector. In such connectors, both ends of the connector are still mateable to other connectors, in pin-and-socket connections.

The transformer 40 shown in FIG. 1, is formed on a torroidal bobbin, which saves space and allows it to be installed within the shell 12. The connections, preferably through traces on the circuit board, enable the combination of a connector part and transformer to be provided in a compact package, that does not require external terminations in as much as all internal terminations are made at the factory that produces or assembles the connector part for sale.

Although the schematic circuit diagrams show the first and second windings to be separate windings they can, if DC isolation is not required, be part of an auto transformer that has a single winding with appropriate taps. The torroidal transformer can be mounted on the circuit board, which facilitates assembly, especially since electrical connections are made through traces on the circuit board.

Figure 1A:
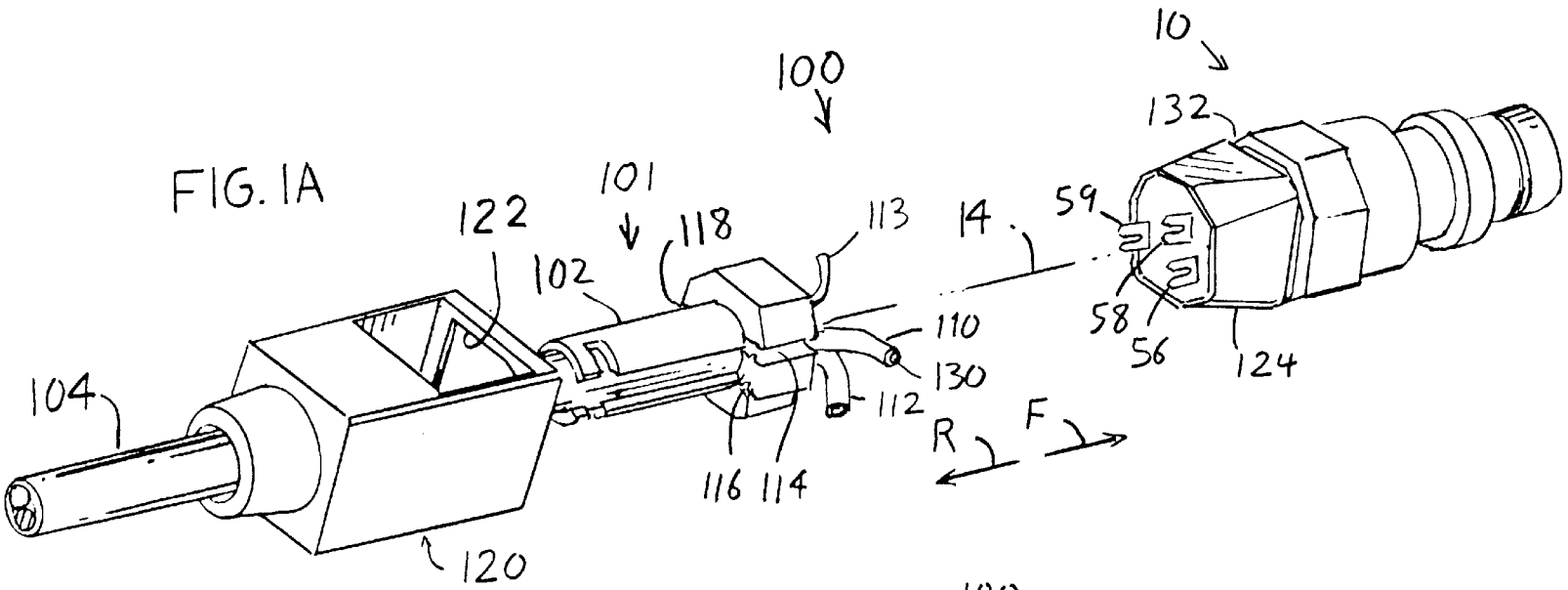
FIG. 1A is a rear isometric view of the connector part of FIG. 1, and also showing a termination assembly and a holder that can be assembled with a connector part to form a complete connector assembly.
Figure 1B:
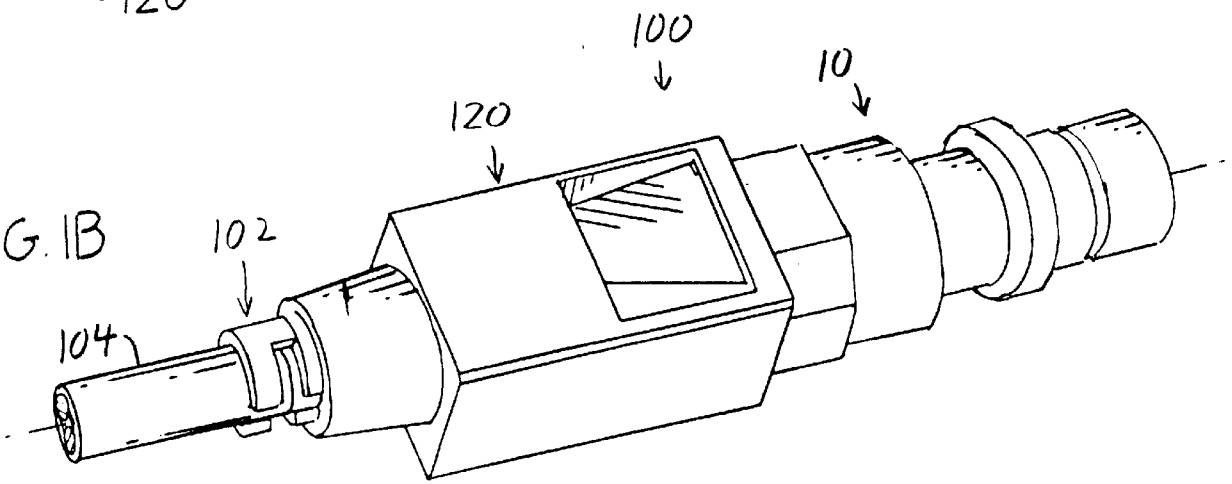
FIG. 1B is a view similar to that of FIG. 1A, but showing the connector part, terminal assembly, and holder fully assembled.

FIG. 1 shows that the rear contacts 56, 58 (and another) are insulation displacement contacts. This allows the connector part 10 of FIG. 1 to be assembled, as shown in FIGS. 1A and 1B into a complete connector assembly 100. The connector assembly includes a terminal assembly 101, with a clamp 102 that holds a cable 104, and which positions wires 110, 112, 113 at the front end of the cable. The wires are bent by at least about 90°, and preferably by about 180° to fit into slots 114, 116, 118. The terminal assembly 101 can be retracted into a holder 120 that positions the terminal assembly, with the holder having an alignment hole 122 at its front end. Thereafter, the connector part 10 can be moved rearwardly so that a rear entry section 124 of the connector part enters the alignment hole 122 and its rear contacts 56, 58, which are insulaton-displacement types, can receive the wires 110, 112 to mate electrical connections therewith. Usually, the wires 110, 112 are insulated, and the insulation displacement contacts 56, 58 displace the insulation and make contact with the central conductors 130 of the wires, as is known in the art. The bare wire 113 engages the similar contact 59, although only two wires and two rear contacts are required. The fact that the wires are bent by at least about 90°, results in the wires extending perpendicular to the axis 14 at the locations where they engage the insulation displacement contacts 56, 58, 59 for effective connection thereat.

The rear entry section 124 has a cutout at 132 that snaps into the walls of the alignment hole 122 to hold the connector part 10 securely within the holder, and in continuing engagement with the wires 110, 112, 113 held by the terminal assembly 101. The holder 120 deforms so its side walls are slightly curved, to receive the rear entry section.

Figure 6:
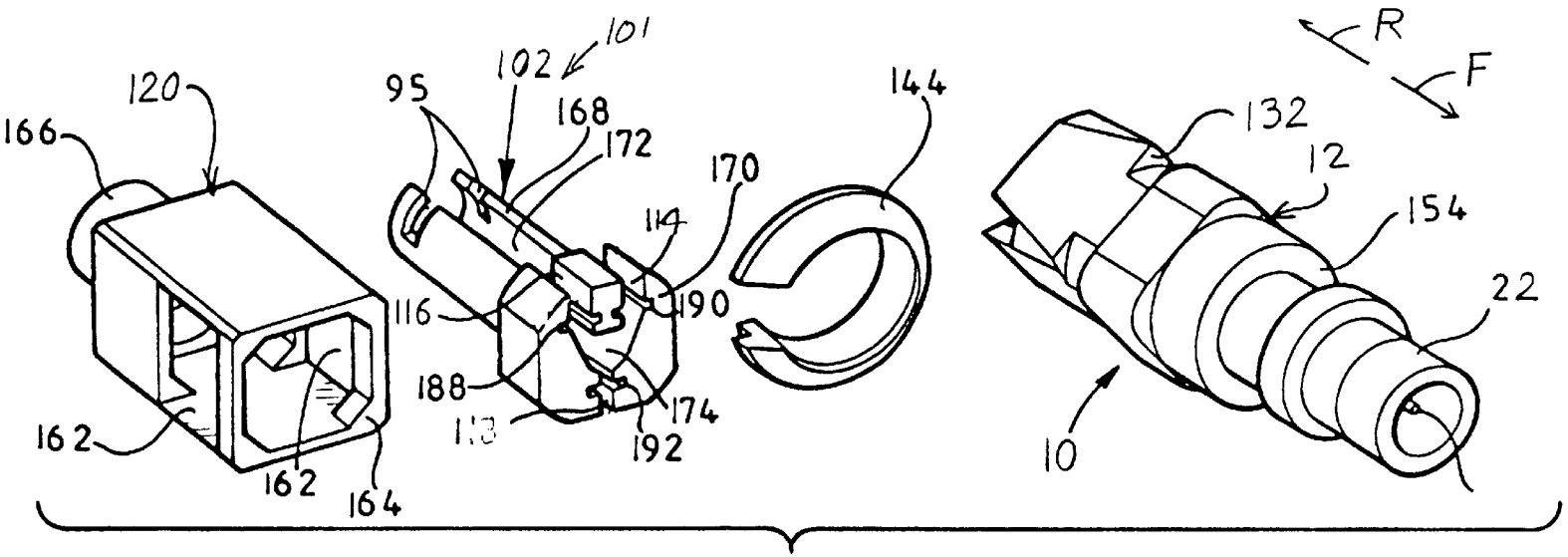
FIG. 6 is an exploded isometric view of the components of the connector assembly of FIGS. 1A and 1B, and also showing a panel clamp.
Figure 7:
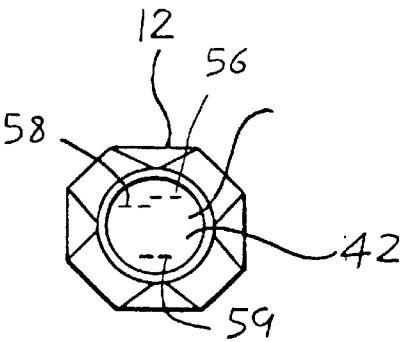
FIGS. 7–13 illustrates steps in the assembly of parts of the connector assembly of FIGS. 1A, 1B, and 6.

FIG. 6 is an exploded view of the connector assembly 100, showing the holder 120, the termination assembly 101, the connector part 10, and an optional locking ring 144 for locking the assembly to a panel through which the assembly extends. The shell has an undercut 154 which can receive the locking ring 144. The rear entry section 124 is of largely rectangular cross-section, preferably square, with corner edges tapered to facilitate insertion into the holder 120.

The holder 120 has side opening cutouts 162 in two of its opposite walls, with corner webs 164 provided. The corner webs engage the notches 132 of the connector part shell when inserted into the holder, to provide a latching. The rear end of the holder includes a largely cylindrical portion 166 through which the cable extends.

The cable clamp 102 can be molded from an insulating material. One end portion 168 fits closely within the cylindrical portion 166 at the rear of the holder. The front end of the cable clamp includes a flange 170 that fits closely within the largely square holder 120. The portion 168 has a channel 172 extending at forward and rearward directions, which forms a passage for receiving a cable front portion. The channel communicates with an aperture 174 that extends through the flange 170, with the three grooves 114, 116, 118 extending along the forward end of the flange and merging with the periphery of the clamp. The three grooves are each provided with a slot 188, 190, 192 that extends along each side of a corresponding groove. The slots are disposed to permit entry of the insulation displacement contacts 56, 58, 59.

Figure 8:
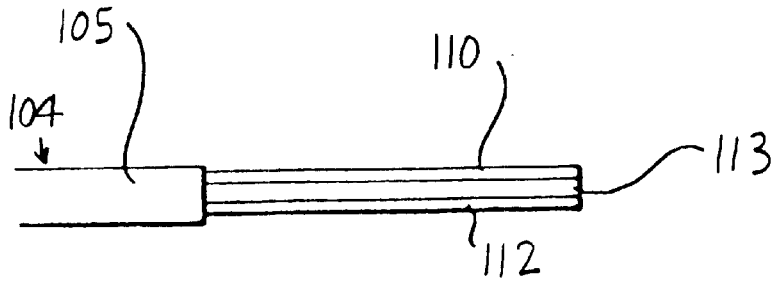
Figure 9:
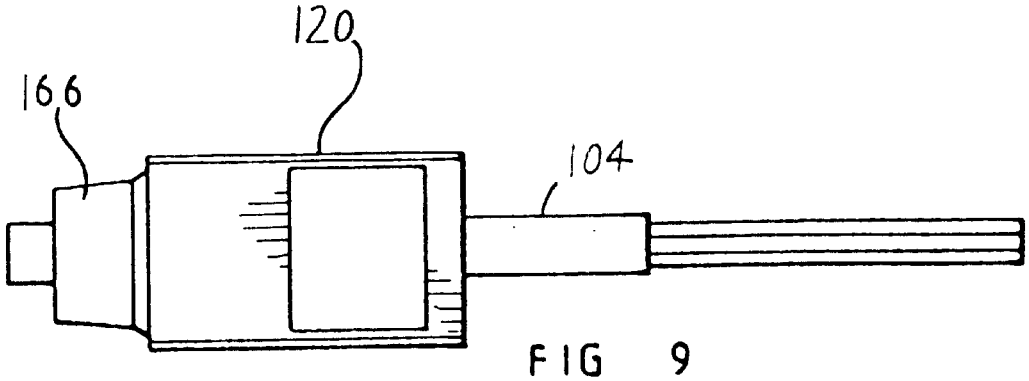
Figure 10:
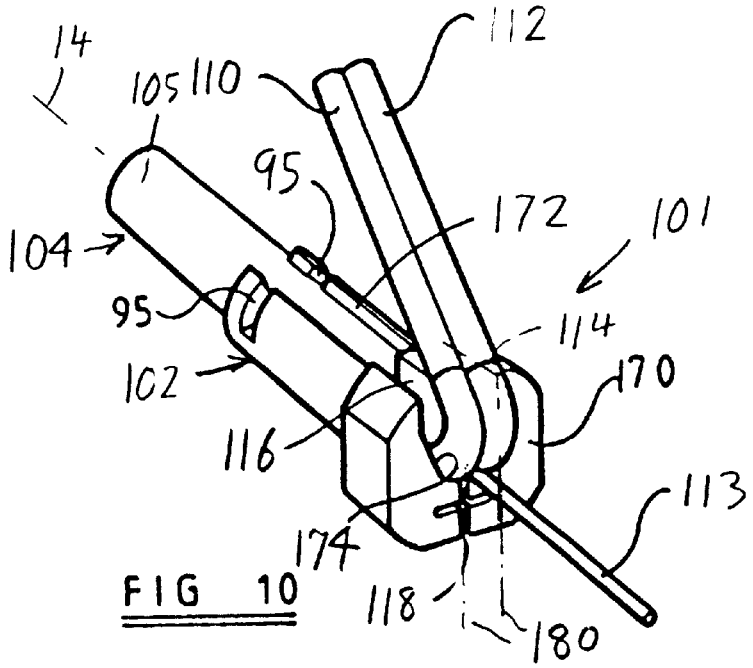

FIG. 8 shows a cable 104 with its outer insulation jacket 105 trimmed back to expose two insulated wires 110, 112, with an additional bare wire 113 being provided ready for termination to the connector part. FIG. 9 shows the cable front portion inserted through the largely cylindrical portion 166 of the holder 120. As shown in FIG. 10, the cable is inserted forwardly through the cable clamp 102 into the channel 172. The wires 110, 112, 113 are threaded through the aperture 174 in the flange 170 until the outer jacket 105 of the cable lies against a back face of the flange 170. The wires are then bent more than 90° back over the flange and down into one of the grooves 114, 116, 118 and along the corresponding groove. FIG. 10 shows the wires prior to pressing them into the grooves, with front wire ends extending along imaginary lines 180 that are perpendicular to the axis 14 to facilitate connection to the insulation displacement contacts.

Figure 11:
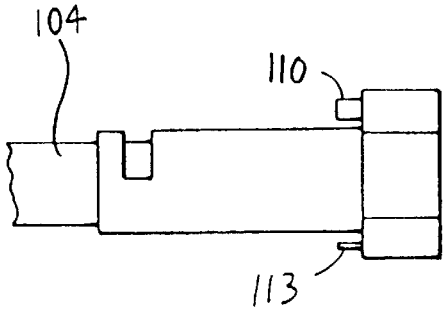
Figure 12:
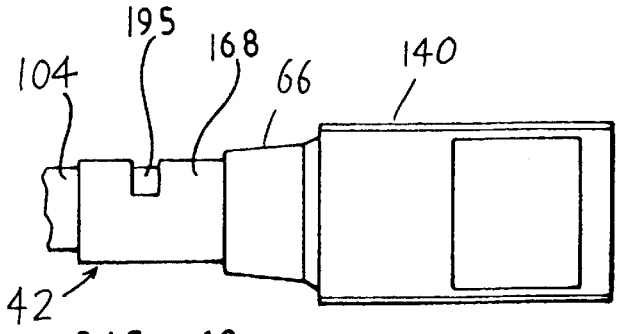
Figure 13:
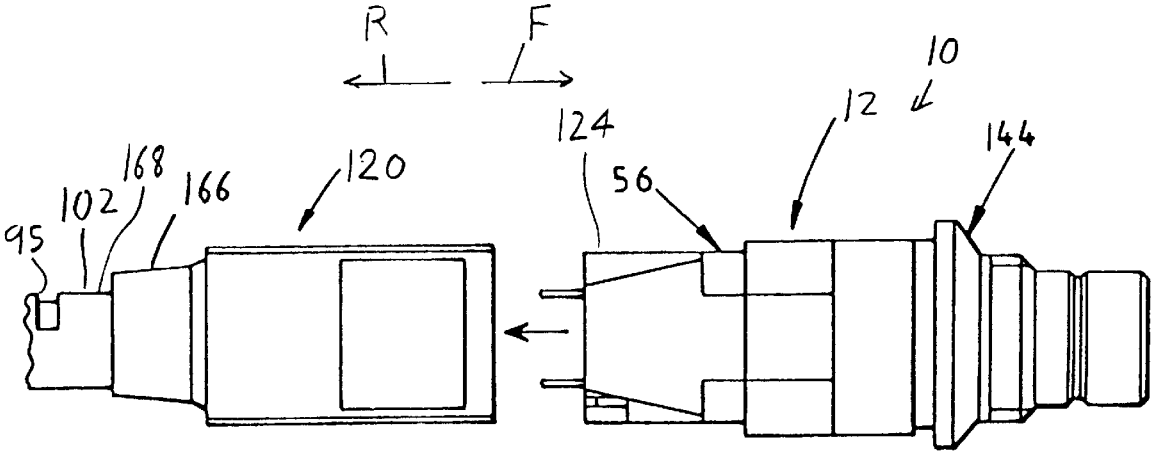

The grooves 114, 116, 118 are sized such that the wires are a dose fit and preferably an interference fit, to provide wire retention. The wires are trimmed back so when pressed into the grooves they lie dose to the flange as shown at 110, 113 in FIG. 11. The cable clamp 102 is now pushed into the holder 120, to the position shown in FIG. 13. The bore of the cylindrical portion 166 is tapered rearwardly, so the clamp portion 168 becomes compressed as the clamp is inserted into the holder 120. Clamping is enhanced by the presence of notches 95.

In order to terminate the cable wires to the connector part 10, the shell 12 of the connector part is inserted rearwardly into the box-like open end of the holder 120. A close fit between the rear entry section 124 and the holder 120, results in the wires entering the slots 57 (FIG. 1) of the insulation displacement contacts. The slots shown in FIG. 6 at 188, 190, 192 provide support for the tines of the insulation displacement contacts to avoid damage. At full insertion, the front walls of the holder beside the alignment hole 122 (FIG. 1A) snap into the cutouts 132 at the rear of the rear entry sector 124 of the shell.

Because of the fact that three insulation displacement connectors engage three wire conductors (and displace insulation around two of them) it is anticipated that the force may be high and a mating tool may be employed. When the termination is completed, the locking ring 44 can be pressed onto the shell as shown in FIG. 1, and snapped into an undercut region thereat to locate the connector assembly on a panel. This arrangement enables connectors to be mounted on panels, with small lateral distances (perpendicular to axis 14) between adjacent connectors, such as 10 mm.

Although two or three wires are shown, more can be employed.

Thus, the invention provides a connector or connector part with contacts at the front end and with contacts or cable or wire termination means at its rear end. A transformer with two winding portions are contained within an electrically conductive connector shell to protect the windings and provide connections between the windings and contacts within the shell, for a compact and reliable connection in a connector that has an impedance transformation and possible DC isolation. A connector part with insulation displacement contacts at its rear end, can connect to a cable by a termination assembly that includes a clamp that holds the cable and with a front portion having grooves that receive the cable and that leave front wire ends extending perpendicular to the axis of the connector part, so rearwardly-facing insulation displacement contacts can engage the wires by moving the connector part rearwardly against the termination assembly. A hollow box-like holder receives the termination assembly and has a front end into which an entry sector of the connector part can be inserted, to align the connector part with the termination part for accurate wire displacement connection and for latching of the connector part to the holder.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector part having front and rear ends and having a pair of front contacts at said front end and a pair of rear contacts at said rear end, comprising:

an electrically conductive housing in the form of a shell that has a primarily cylindrical inside surface and that has an axis that is concentric with said cylindrical inside surface, said shell having a through passage therein, and said shell having front and rear portions, with one of said front contacts formed by said shell;

an insulator device lying in said housing;

an inner coaxial conductor extending along said axis and lying within said insulator device, with said inner conductor and said shell being accessible from said connector part front end and forming said front contacts to connect thereto in a coaxial connection;

said insulator device having upper and lower locations that substantially abut the inside of said shell to fix the location of said insulator device within said connector shell and to hold said inner coaxial conductor so it extends along said axis;

a transformer having first and second winding portions, with said first winding portion coupled to said pair of front contacts and with said second winding portion coupled to said pair of rear contacts;

said transformer lying within said shell.

2. The connector part described in claim 1 including:

a termination assembly which includes a cable clamp for holding a cable with at least two cable wires; and wherein said rear contacts are in the form of insulation displacement contacts that have rearwardly-opening slots, for receiving and terminating to said at least two cable wires;

said housing forms a rear sector; and including a holder that fits around said rear sector of said connector part and said rear termination assembly to hold them together.

3. The connector part described in claim 1 including:

a circuit board lying in said shell and having a plurality of conductive traces thereon that are connected to said transformer and to at least some of said contacts, said circuit board having parallel opposite faces and lying in a plane that is normal to said axis.

4. The connector part described in claim 1 wherein:

said transformer is of toroidal shape with a hole at its center, and said inner coaxial conductor extends along said axis and through said hole at the center of said transformer.

5. A connector part having front and rear ends and having a pair of front contacts at said front end and a pair of rear contacts at said rear end, comprising:

an electrically conductive housing in the form of a shell with a shell axis and with a through passage therein, said shell having front and rear portions;

one of said contacts is a center contact that extends substantially along said axis;

an insulator device lying in said housing;

a transformer lying in said shell between said front and rear pairs of contacts with said transformer having first and second winding portions, said first winding portion coupled to said pair of front contacts and said second winding portion coupled to said pair of rear contacts;

said windings portions are each wound about a winding axis that is substantially parallel and coincident with said shell axis.

6. The connector part described in claim 5 including:

a circuit board lying closely in said shell and having a board plane extending normal to said axis, said circuit board having conductive traces connected to said transformer and to said contacts.

7. The connector part described in claim 5 wherein:

said front contacts are coaxial contacts with said shell front portion forming one of said front contacts and with a second of said front contacts comprising an inner coaxial conductor extending along said axis;

said transformer is of torroidal shape with a central hole lying on said axis, and said inner conductor extends through said transformer hole.

8. The connector part described in claim 5 wherein:

said front contacts are coaxial contacts with said shell front portion forming one of said front contacts and with a second of said front contacts comprising an inner coaxial conductor extending along said axis;

a first of said transformer windings is connected between said inner coaxial conductor and said shell, and a second of said windings is connected between said rear contacts.

9. A connector part having front and rear ends and having a pair of front contacts at said front end and a pair of rear contacts at said rear end, comprising:

an electrically conductive housing in the form of an elongated shell with an axis extending along the length of the shell and with a through passage therein, said shell having front and rear portions spaced along said axis;

an insulator device lying in said shell;

a transformer lying in said shell between said front and rear pairs of contacts with said transformer having first and second winding portions, with said first winding portion coupled to said pair of front contacts and with said second winding portion coupled to said pair of rear contacts;

a circuit board lying in said shell and having a board with faces extending normal to said axis, said circuit board having a first face with conductive traces of conductive sheet metal bonded to the circuit board first face and connected to said transformer and to a plurality of said contacts.

10. The connector part described in claim 9 wherein:

said shell has an inside with a cross-section;

said circuit board lies closely within said shell and occupies substantially the entire inside cross-section space of said shell at said circuit board.

11. The connector part described in claim 9 wherein:

said circuit board has a hole, with one of said traces extending to said hole;

said pair of front contacts include inner and outer coaxial contacts, with said inner front contact projecting into said hole in said circuit board and soldered to said one of said traces at said hole.

12. A connector part having front and rear ends, comprising:

an electrically conductive housing in the form of a shell, with an axis and with a through passage, said shell having front and rear portions that respectively form front and rear outer coaxial conductor portions;

front and rear inner coaxial conductor portions lying at said front and rear ends within said shell;

insulator means lying in said housing and supporting said inner conductor portions within said shell;

transformer means for producing a controlled ratio of impedances at said opposite ends of said connector part, said transformer means having first and second winding portions, with said first winding portion coupled to said pair of rear conductor portions and said second winding portion coupled to said pair of front conductor portions, and with said transformer lying in said shell;

each of said winding portions occupying at least half of the cross-sectional area within said shell which lies outside said inner conductor portions, as viewed along said axis at the locations of said winding.

13. The connector described in claim 12 including:

a circuit board lying in said shell and having parallel opposite faces lying in planes that are normal to said axis, with a first of said faces having electrically conductive traces in the form of thin layers of metal bonded to said first face, with said traces connected to at least some of said windings.

* * * * *